US009541261B2

(12) United States Patent
Klase et al.

(10) Patent No.: US 9,541,261 B2
(45) Date of Patent: Jan. 10, 2017

(54) SYSTEMS AND METHODS FOR A DYNAMIC LIGHT FIXTURE

(71) Applicant: Build My LED, Austin, TX (US)

(72) Inventors: Nicholas Klase, Austin, TX (US); Randall Johnson, Austin, TX (US)

(73) Assignee: Fluence Bioengineering, Austin, TX (US)

( * ) Notice: Subject to any disclaimer, the term of this patent is extended or adjusted under 35 U.S.C. 154(b) by 21 days.

(21) Appl. No.: 14/788,837

(22) Filed: Jul. 1, 2015

(65) Prior Publication Data

US 2016/0003453 A1 Jan. 7, 2016

Related U.S. Application Data

(60) Provisional application No. 62/019,802, filed on Jul. 1, 2014.

(51) Int. Cl.

| | |
|---|---|
| ***F21V 14/02*** | (2006.01) |
| ***F21S 8/06*** | (2006.01) |
| *F21V 21/34* | (2006.01) |
| *F21S 8/00* | (2006.01) |

(52) U.S. Cl.

CPC ..... *F21V 14/02* (2013.01); *F21S 8/066* (2013.01); *F21S 4/28* (2016.01); *F21S 8/038* (2013.01); *F21V 21/34* (2013.01); *F21Y 2103/10* (2016.08); *F21Y 2115/10* (2016.08)

(58) Field of Classification Search

CPC ..... F21V 14/02; F21V 21/34; F21S 8/066; F21S 8/035; F21S 4/28; F21Y 2103/10; F21Y 2115/10

USPC ..... 362/219, 220, 225, 648, 217.14, 217.15,362/217.16, 217.17

See application file for complete search history.

(56) References Cited

U.S. PATENT DOCUMENTS

| | | | | |
|---|---|---|---|---|
| 5,785,411 | A * | 7/1998 | Komai | F21V 19/0085 362/219 |
| 5,833,358 | A * | 11/1998 | Patik | F21V 21/0808 362/239 |
| 6,170,967 | B1 * | 1/2001 | Usher | F21V 23/06 200/227 |
| 8,348,492 | B2 * | 1/2013 | Mier-Langner | F21V 21/096 362/147 |
| 2003/0137835 | A1 * | 7/2003 | Mier-Langner | F21S 8/06 362/220 |
| 2008/0273321 | A1 * | 11/2008 | Mundle | F21V 7/0016 362/220 |
| 2009/0103330 | A1 * | 4/2009 | Caldani | F21V 23/02 362/648 |
| 2015/0159840 | A1 * | 6/2015 | Liu | F21V 21/35 362/648 |

* cited by examiner

*Primary Examiner* — Laura Tso

(74) *Attorney, Agent, or Firm* — Pierson IP, PLLC

(57) ABSTRACT

Embodiments disclose herein describe systems and methods for a dynamic light fixture. More particularly, embodiments disclose a light fixture with dynamic components that may be moved to change an irradiance distribution of a light pattern.

9 Claims, 7 Drawing Sheets

700

800

SYSTEMS AND METHODS FOR A DYNAMIC LIGHT FIXTURE

CROSS-REFERENCE TO RELATED APPLICATIONS

This application claims a benefit of priority under 35 U.S.C. §119 to Provisional Application No. 62/019,802 filed on Jul. 1, 2014, which is fully incorporated herein by reference in their entirety.

BACKGROUND INFORMATION

Field of the Disclosure

Examples of the present disclosure are related to systems and methods for a dynamic light fixture. More particularly, embodiments disclose a light fixture with dynamic components, wherein the dynamic components may be moved to change the spatial light exitance distribution and/or rotated to change the light irradiance distribution over a region of interest.

Background

A light fixture is an electrical device used to create artificial light. Conventional light fixtures include a fixture body and a light socket, wherein the light socket holds a light source in place.

Conventionally, the fixture body may be moved or rotated, but the physical dimensions of the fixture body remain geometrically static. When moving and/or rotating a conventional light fixture, the irradiance distribution of the fixture's light pattern will be modified based on the distance and angle between the light source and the region of interest, but the exitance distribution of the fixture's emitted light will remain constant. Therefore, conventional light fixtures do not allow the modification of exitance distribution of emitted light.

Furthermore, conventional light fixtures remain geometrically static because conventional light fixtures are utilized to illuminate a region of interest positioned far away from the light source. In situations where the region of interest is positioned far away from the light source, the region of interest can be much larger than the light source. Due to beam divergence of the emitted light affecting the faraway region of interest, the light irradiance distribution on the faraway region of interest may be modified by changing the irradiance distribution of the light source.

However, situations may arise when the light source is positioned proximate to a region of interest, where the emitted light does not have space to diverge. However, when the emitted light does not have space to diverge, the light exitance distribution on the proximate region of interest cannot be changed by only modifying the intensity distribution of the light fixture. Therefore, if the light source does not have space to diverge, the light irradiance distribution caused by conventional light fixtures on proximate regions of interest will not be uniform. This is problematic when plants are positioned within a proximate region of interest, and the plants require the same light irradiance.

Accordingly, needs exist for more effective and efficient systems and methods for light fixtures to modify the light exitance distribution for a near field region of interest.

SUMMARY

Embodiments disclosed herein describe systems and methods for a dynamic light fixture. In embodiments, the light fixture may include dynamic components, which allow the geometry of the light fixture and positioning of the light sources to change. Responsive to changing the geometry of the light fixture and the positioning of the light sources, the light irradiance distribution on a region of interest may be modified.

Embodiments disclosed herein may include a rail and a plurality of light bars. The rail may be a hardware device configured to couple with and secure the plurality of light bars. The light bars may be configured to store a plurality of light sources, such as light emitting diodes (LEDs).

In embodiments, the light bars may be configured to couple with the rail, such that the light bars may be moved along an abscissa axes, ordinate axes, and/or applicate axes, and/or rotated vertically and horizontally. Responsive to the light bars being moved and/or rotated, the light exitance and irradiance distribution of the light bars on a region of interest may be modified.

In embodiments, the light bars may be moved and/or rotated to have a light pattern on a region of interest with a substantially uniform light irradiance.

In embodiments, the light bars may be configured to be positioned perpendicularly to the rail. The light bars may also be configured to be positioned at an offset position, wherein more a light bar may be extended further away from a first side of the rail than a second side of the light rail.

In embodiments, the distance between each of the light bars coupled to the rail may be equal, or the distance between the light bars coupled to the rail may be different. Therefore, the dynamic light fixture may include light bars that may be dynamically positioned on the rail.

In embodiments, due to superposition of the light emitting from the light bars, the light bars positioned more proximate to the ends of the rail may be positioned closer together than the light bars centrally positioned on the rail.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
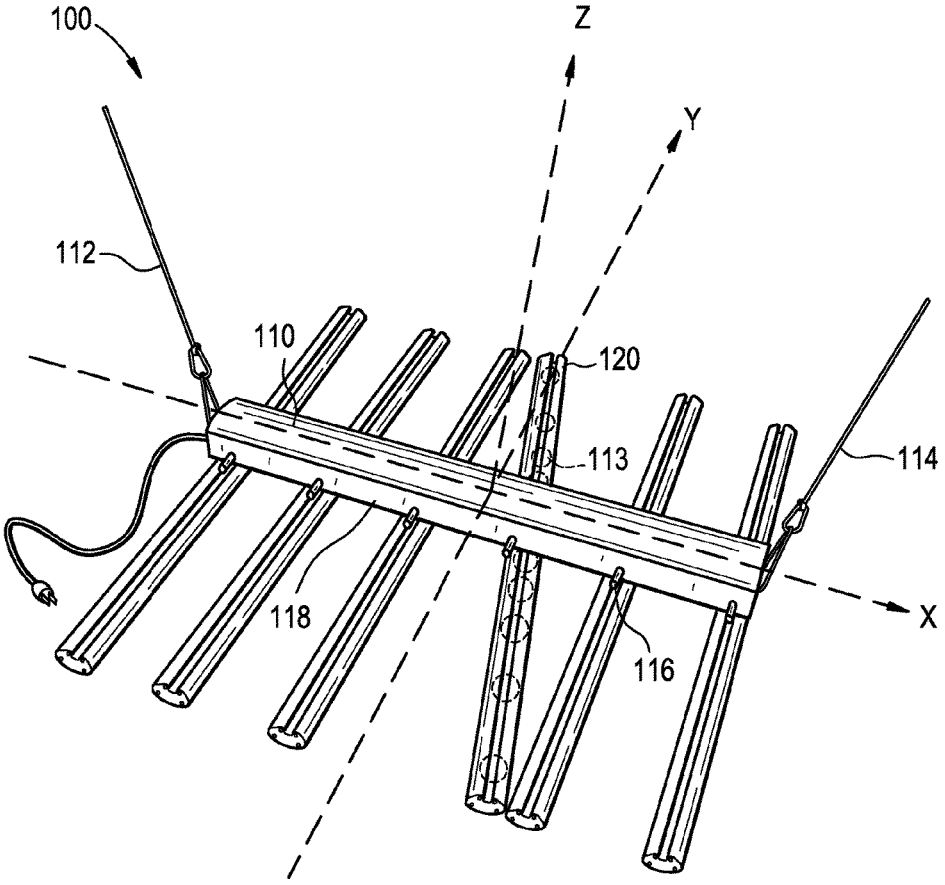
FIG. 1 depicts a dynamic light fixture, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments disclosed herein describe systems and methods for a dynamic light fixture. The light fixture may include dynamic components that are configured to be moved and/or rotated. Responsive to the dynamic components being moved and/or rotated, the geometry of the light fixture may change. Responsive to changing the geometry of the light fixture, the light radiance distribution of the light fixture may be modified, which may correspondingly adjust the irradiance distribution of the light source on a region of interest.

FIG. 1 depicts one embodiment of a dynamic light fixture 100. Dynamic light fixture 100 may include a rail 110 and at least one light bar 120.

Rail 110 may be a linear shaft configured to support a load. Rail 110 may be comprised of various materials, such as plastics, metals, polymers, etc. Rail 110 may include first support member 112, second support member 114, light bar interface 116, and track 118.

First and second support members 112, 114 may be cables, hooks, etc. First support member 112 may be configured to be positioned on, or proximate to, a first end of rail 110, and second support member 114 may be configured to be positioned on, or proximate to, a second end of rail 110. The first and second support members 112, 114 may be configured to secure rail 110 in place above a region of interest. In embodiments, first and second support members 112, 114 may be configured to vertically move dynamic light fixture 100. By vertically moving dynamic light fixture 100, a vertical distance between rail 110 and the region of interest may be changed.

Light bar interface 116 may be configured to receive light bars 120, and couple light bars 120 to rail 110. Light bar interface 116 may be a projection extending away from a lower surface of rail 110, wherein a first end of light bar interface 116 may be positioned within track 118 and a second end of light bar interface may be positioned within light bar 120. Light bar interface 116 may also be configured to allow light bar 120 to move in a direction between the first and second ends of rail 110 via track 118. More specifically, by sliding light bar interface within track 118, light bar 120 may move from the first end of rail 110 to a second end of rail 110.

Furthermore, because light bar interface 116 includes a projection that extends past a lower surface of light bar interface, light bar 120 may rotate in directions between the first end of rail 110 and the second end of rail 110. Light bar interface 116 may be configured to allow light bar 120 to be positioned in a direction perpendicular to rail 110, and also in directions that are angularly offset from rail 110. Accordingly, light bar interface 116 may allow light bar 120 to rotate in an abscissa axes, ordinate axes, and/or applicate axes. When light bar 120 rotates along an abscissa axes, a first end of light bar 120 may be positioned adjacent to a lower surface of rail 110. Furthermore, in embodiments, light bar 120 may not be able to rotate a full 180 degrees, such that light emitted from light bar 120 may always be positioned at a downward angle.

In embodiments, where light bar 120 is angularly offset from rail 110, a first end of light bar 120 may be positioned closer to a first end of rail 110 than a second end of light bar 120. Light bar interface 116 may also be configured to allow light bar 120 to slide, move, etc. in a direction perpendicular to rail 110 along an ordinate axis, wherein a first end of light bar 120 may extend further away from rail 110 than the second end of light bar 120.

Track 118 may include grooves, indentions, channels, etc. within rail 110, wherein the grooves, indentions, channels, etc. are configured to receive light bar interface 116. Responsive to track 118 receiving light bar interface 116, track 118 may control the spatial movement of light bar 120 along a liner axis, wherein the linear axis may extend from the first side of rail 110 to the second side of rail 110. In further embodiments, rail 110 may also include vertical tracks (not shown). The vertical tracks may be configured to allow light bar 120 to move in vertical directions above and below rail 110, wherein the vertical tracks may be positioned at various increments between the first end of rail 110 and the second end of rail 110. Additionally, the vertical tracks may be dynamic, such that the positioning of the vertical tracks along rail 110 may be changed. Accordingly, different light bars 120 may be positioned at different vertical distances away from a region of interest.

Light bar 120 may be a housing configured to secure at least one light source 113, such as an LED in place. The light sources 113 may be positioned from a first side of light bar 120 to a second side of light bar 120. In embodiments, the light sources 113 may be evenly spaced from the first side of light bar 120 to the second side of light bar 120, or be positioned at varying intervals. The light sources 113 may be positioned at different intervals, wherein the intervals decrease as the light sources 113 are positioned closer to the sides of light bar 120. The intervals may decrease due to super-positioning the light sources 113, wherein there may be less overlap of the emitted light from the light sources 113 positioned closer to the sides of light bar 120 than the center of light bar 120.

Furthermore, light bar 120 may be configured to move and rotate while coupled to rail 110. Responsive to light bar 120 moving and/or rotating, the geometry of dynamic light fixture 100 may change, wherein changing the geometry of the dynamic light figure 100 may adjust the irradiance distribution of the light sources on a region of interest. In embodiments, with a plurality of light bars 120, each of the light bars may be configured to be moved independently from the other light bars. Accordingly, each of the light bars may have different vertical offsets, horizontal positioning, angular offsets, angle of rotation, etc.

As depicted in FIG. 1, light bars 120 are uniformly spaced along rail 110. In embodiments, when light bars 120 are positioned from the first side of rail 110 to the second side of rail 110, dynamic light fixture 100 may have a wide distribution of light. Responsive to dynamic light fixture 110 having a wide distribution of light, a region of interest that is proximate to dynamic light fixture 100 may have a substantially uniform light irradiance, and the region of interest may have substantially the same size as the light sources.

Figure 2:
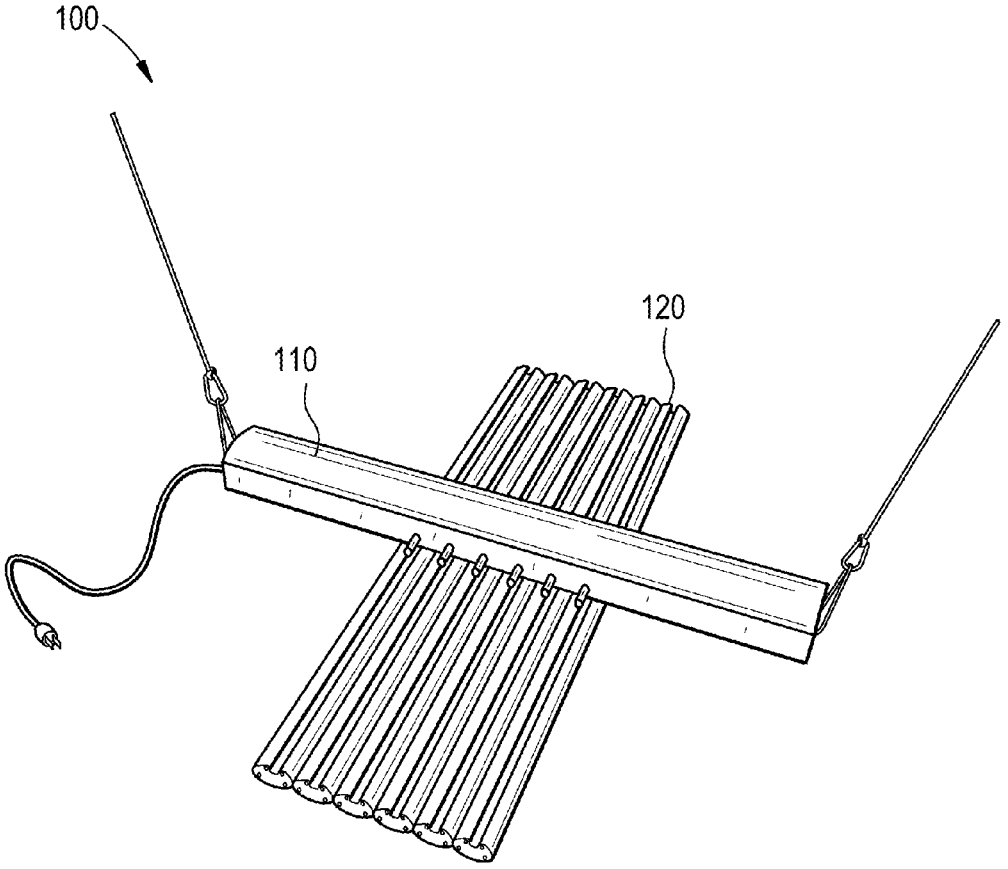
FIG. 2 depicts a dynamic light fixture having a narrow distribution of emitted light, according to an embodiment.

FIG. 2 depicts one embodiment of a dynamic light fixture 100 having a narrow distribution of emitted light. As depicted in FIG. 2, light bars 120 may be spatially adjusted to be positioned adjacent to one another. Responsive to changing the positioning of light bars 120, the emitted light pattern and corresponding light uniformity may be changed.

Furthermore, light bars 120 may be spatially adjusted based on the size of the region of interest, wherein the size of the source lighting may be substantially similar to the region of interest. Accordingly, for a smaller region of interest, light bars 120 may be positioned proximate to one another. Responsive to spatially adjusting the positioning of light bars 120, dynamic light fixture 100 may create a uniform light irradiance over the near field region of interest.

Figure 3:
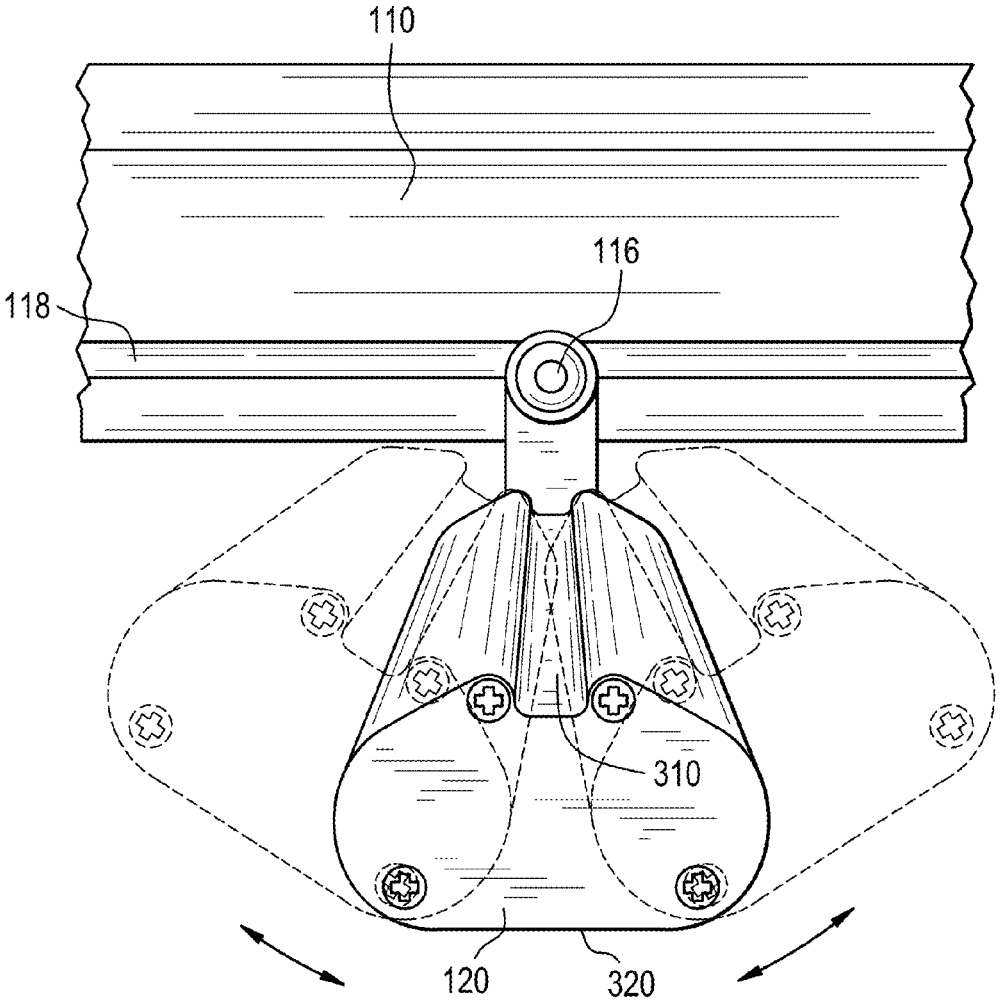
FIG. 3 depicts a side view of a dynamic light fixture, according to an embodiment.

FIG. 3 depicts one embodiment of a side view of dynamic light fixture 100. As depicted in FIG. 3, light bar 120 may be coupled to rail 110 via light bar interface 116 and track 118. In embodiments, light bar 120 may be coupled to light bar interface 116 via a groove, indention, channel, etc. positioned on a top surface 310 of light bar 120. A first end of light bar interface 116 may be configured to slide into the groove, indention, channel, etc. to couple light bar 120 with rail 110.

While the light bar 120 is coupled to rail 110, light bar 120 may be rotated, tilted, slanted, etc. in a direction towards the ends of rail 110. Therefore, light bar 120 may be rotated such that a bottom surface 320 of light bar 120 may be angled in a different direction. In embodiments, light bar 120 may be rotated such that the bottom surface 320 of light bar 120 faces away, at a downward angle, from either the first end or second end of rail 110.

Responsive to rotating light bar 120, the light source emitted from light bar 120 may be angularly adjusted to modify the light intensity of light bar 120. In embodiments, different light bars 120 may be angularly adjusted at different degrees to have a uniform light irradiance over a region of interest.

Figure 4:
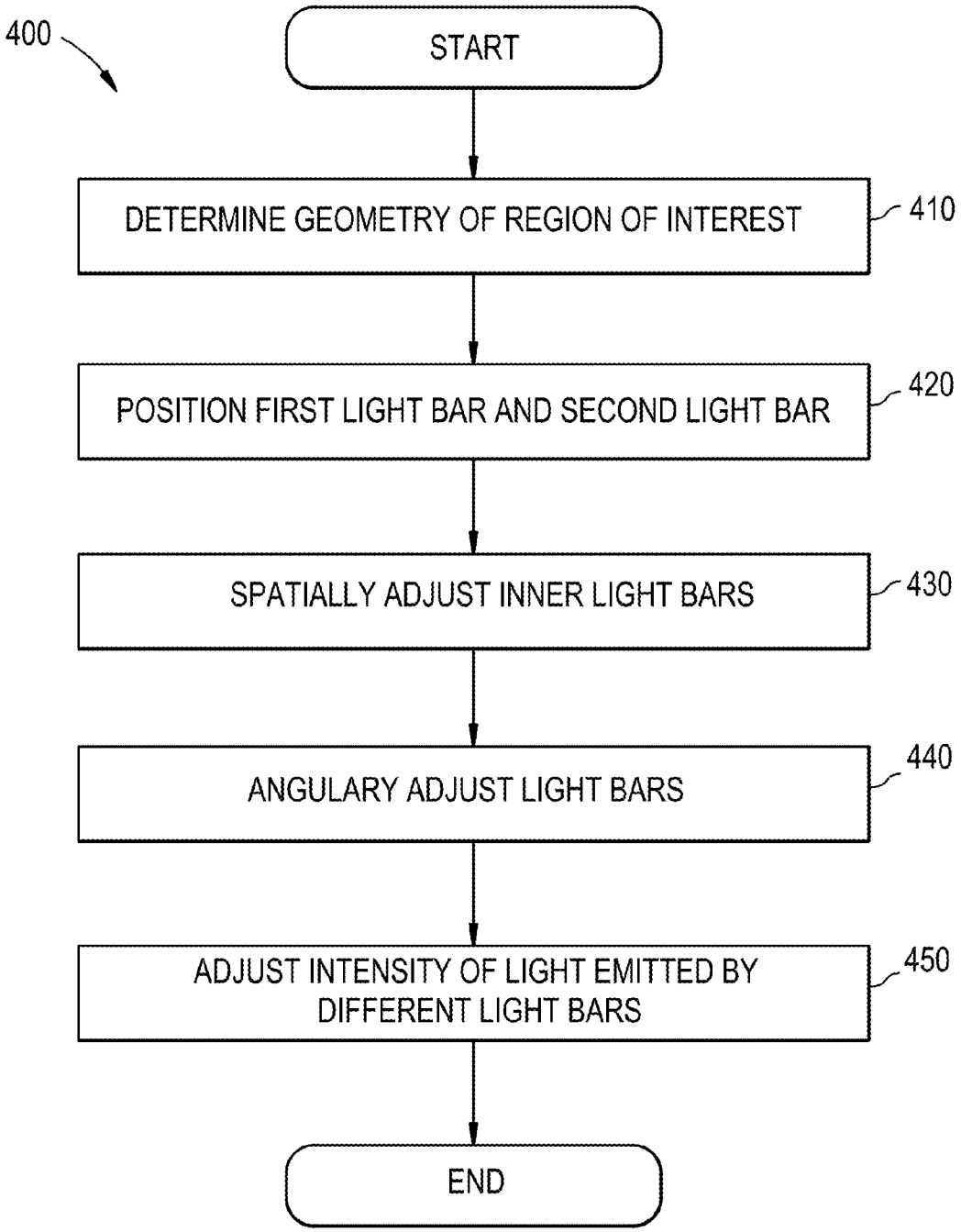
FIG. 4 depicts a method for generating a uniform light irradiance over a near field region of interest, according to an embodiment.

FIG. 4 illustrates a method 400 for generating a uniform light irradiance over a near field region of interest. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting.

At operation 410, a size of the region of interest may be determined. The area of interest may be any desired shape and/or size, such as rectangle, square, circle, etc.

At operation 420, a first light bar may be moved towards a first end of a rail to correspond with a first boundary of the region of interest, and a second light bar may be independently moved towards a second end of the rail to correspond with a second boundary of the region of interest. Therefore, the light bars outmost light bars may be spatially adjusted to substantially correspond to the boundary of the region of interest. For example, if the region of interest is larger, then the first light bar may be moved towards the first end of the rail, and the second light bar may be moved towards the second end of the rail.

At operation 430, adjacent, inner light bars that are positioned most proximate to the first light bar and the second light bar may be spatially adjusted to be positioned at shorter intervals than the light bars spaced proximate to the center of the rail. In embodiments, the light bars positioned proximate to the first light bar and the second light bar may be positioned at closer intervals to account for the superposition of the light emitting from the light bars.

At operation 440, the light bars may be angularly adjusted to change the angular distribution of light on the region of interest. Responsive to adjusting the angular distribution of light, the light irradiance over the region of interest may be adjusted.

At operation 450, the intensity of the light emitted by different light bars may be modified to account for superposition, interference, etc. of the emitted light. In further embodiments, the intensity of the different light sources within a light bar may be adjusted.

Figure 5:
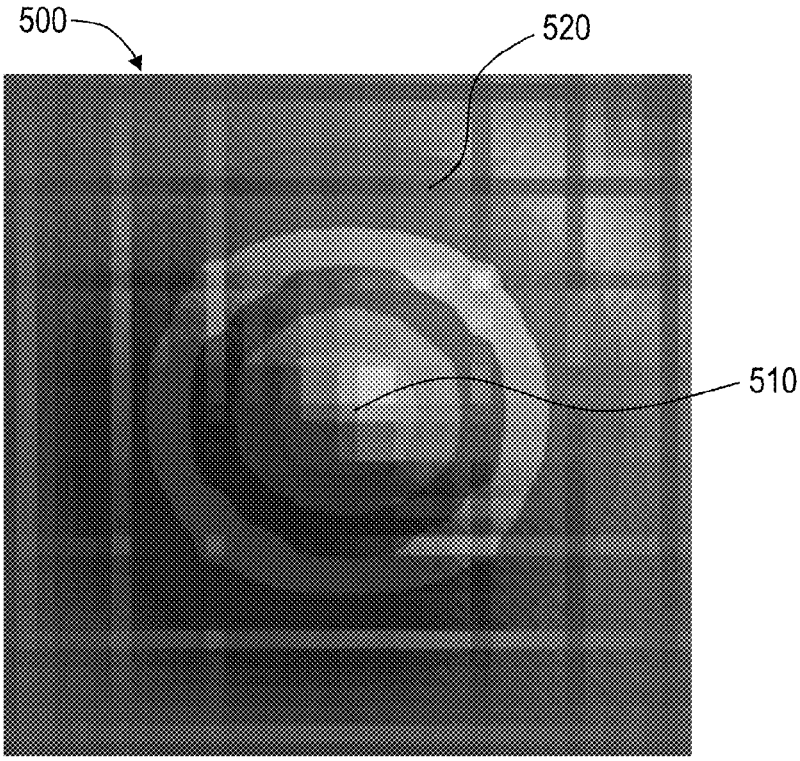
FIG. 5 depicts a light irradiance distribution generated by a conventional light fixture.

FIG. 5 depicts one embodiment of the light irradiance generated by a conventional lighting fixture. As depicted in FIG. 5, the light irradiance is not uniform throughout the region of interest 500.

The light irradiance over the region of interest 500 is highest proximate to the center 510 of the region of interest 500 is most intense near, and lowest proximate to the boundaries 520 of the region of interest 500. In situations where it is desired to have uniform light irradiance over the region of interest 500, the disparity between the light exitance proximate to boundaries 520 and center 510 of the region of interest 510 may be undesirable.

Figure 6:
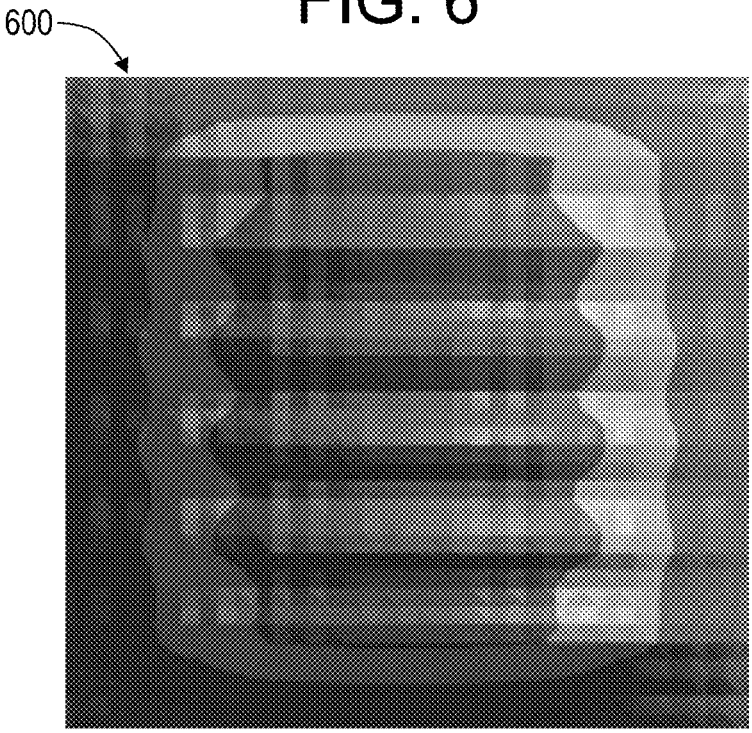
FIG. 6 depicts a light irradiance distribution generated by a dynamic light fixture, according to an embodiment.

FIG. 6 depicts one embodiment of the light irradiance distribution generated by a dynamic light fixture 100. As depicted in FIG. 6, the light irradiance distribution may be substantially uniform throughout the region of interest 600. The light irradiance distribution may be substantially uniform throughout the region of interest 600 by changing the spatial distributions and/or the angular distributions of the light bars 120.

Figure 7:
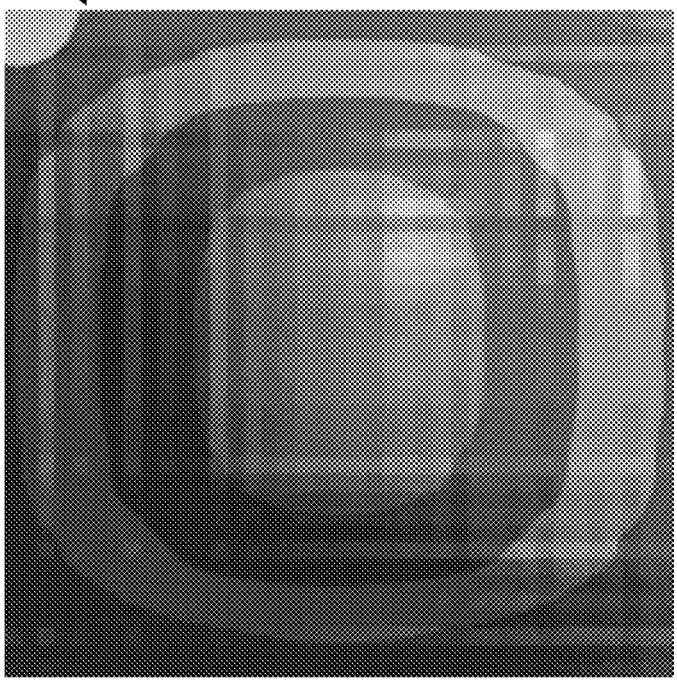
FIG. 7 depicts a light irradiance distribution generated by a dynamic light fixture, according to an embodiment.

FIG. 7 depicts one embodiment of the light irradiance distribution 700 generated by a dynamic light fixture 100. As depicted in FIG. 7, the light irradiance distribution may be spread to achieve maximum coverage. Specifically, a dynamic light fixture 100 may be moved further away from a region of interest allowing divergence of the light sources.

Figure 8:
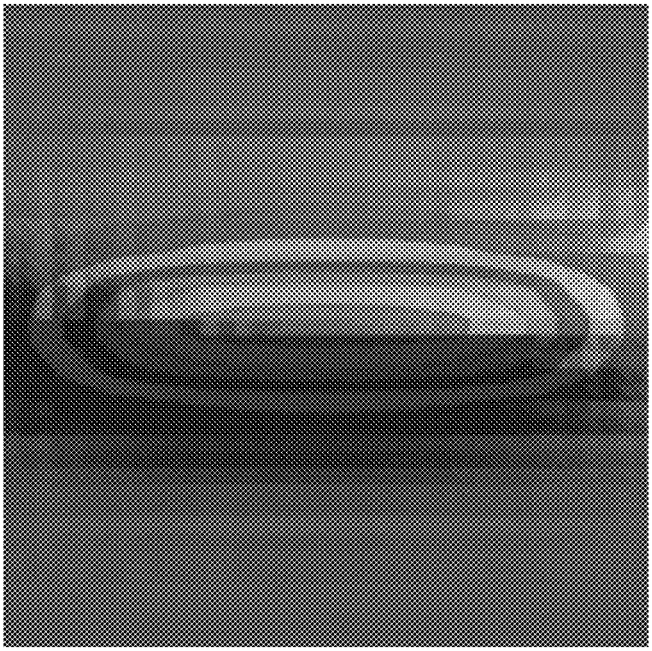
FIG. 8 depicts a light irradiance distribution generated by a dynamic light fixture, according to an embodiment.

FIG. 8 depicts one embodiment of the light irradiance distribution 800 generated by a dynamic light fixture 100. As depicted in FIG. 8, the light irradiance distribution may be centered to achieve maximum par levels. More specifically, a plurality of light bars may be centered, and positioned with a vertical offset of one foot the region of interest.

Figure 9:
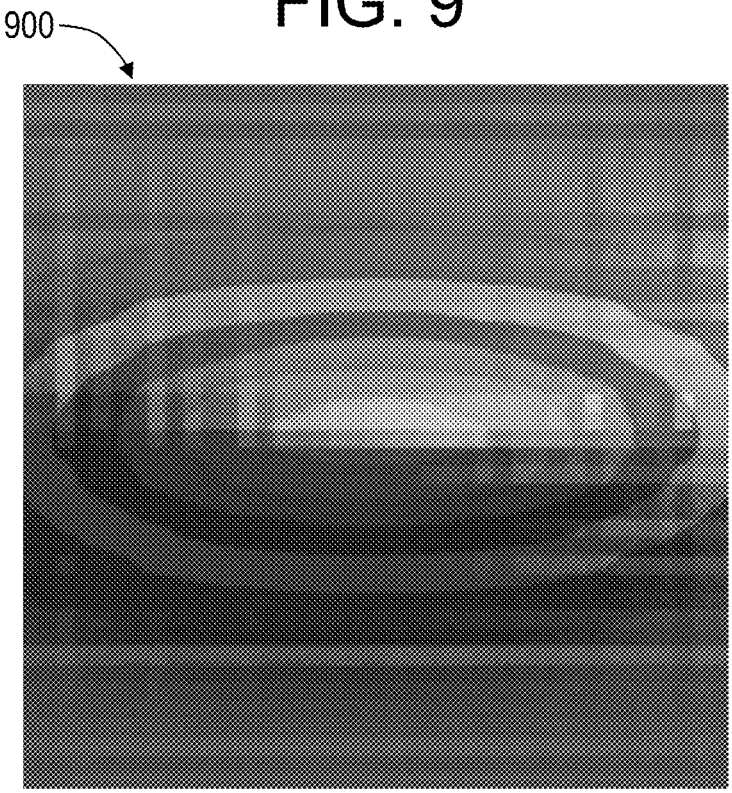
FIG. 9 depicts a light irradiance distribution generated by a dynamic light fixture, according to an embodiment.

FIG. 9 depicts one embodiment of light irradiance distribution 900 generated by a dynamic light fixture. As depicted in FIG. 9, the plurality of light bars may be centered, and positioned with a vertical offset being greater than the vertical offset of the light bars in FIG. 8. Therefore, the light irradiance distribution in FIG. 9 may be more spread than that depicted in FIG. 8.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The flowcharts and block diagrams in the flow diagrams illustrate the architecture, functionality, and operation of possible implementations of systems, methods, and computer program products according to various embodiments of the present invention. In this regard, each block in the flowcharts or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions.

What is claimed is:

1. A dynamic light fixture, comprising:

a rail with a track, the track including channels extending from a first end of the rail to a second end of the rail;

a plurality of light bars being positioned at different locations along the track, wherein each of the plurality of light bars houses a light source;

a plurality of light bar interfaces configured to couple the plurality of light bars to the track, the plurality of light bar interfaces configured to allow each of the plurality of light bars to independently move along the track and be independently rotated, wherein a first light bar includes a plurality of light sources, wherein the plurality of light sources are positioned at different intervals.

2. The dynamic light fixture of claim 1, wherein the plurality of light bar interfaces are configured to allow the plurality of light bars to independently move along an abscissa axis and an ordinate axis.

3. The dynamic light fixture of claim 1, wherein the plurality of light bars are positioned perpendicular to the rail.

4. The dynamic light fixture of claim 1, wherein a first end of a first light bar is horizontally offset from a first end of second light bar.

5. The dynamic light fixture of claim 4, wherein the track is coupled to support members being configured to vertically move the rail.

6. The dynamic light fixture of claim 1, wherein the plurality of light bars are positioned at even intervals along the track to have a spread and uniform distribution of light.

7. The dynamic light fixture of claim 1, wherein the plurality of light bars are positioned adjacent to each other to have a narrow and uniform distribution of light.

8. The dynamic light fixture of claim 1, wherein responsive to changing the positioning of the plurality of light bars, the emitted light pattern of the dynamic light fixture changes.

9. A dynamic light fixture, comprising:

a rail with a track, the track including channels extending from a first end of the rail to a second end of the rail;

a plurality of light bars being positioned at different locations along the track, wherein each of the plurality of light bars houses a light source;

a plurality of light bar interfaces configured to couple the plurality of light bars to the track, the plurality of light bar interfaces configured to allow each of the plurality of light bars to independently move along the track and be independently rotated, wherein a first light bar includes a plurality of light sources, wherein the plurality of light sources are positioned at different intervals, wherein the intervals increase as the light sources are positioned further away from a center of the first light bar.

* * * * *